US005782017A

United States Patent [19]

Ortscheid

[11] Patent Number: 5,782,017

[45] Date of Patent: Jul. 21, 1998

[54] COUPLING DEVICE FOR A TREAD INSERT

[75] Inventor: Dennis J. Ortscheid, Woodbury, Minn.

[73] Assignee: Maven Golf Products LLC, Minneapolis, Minn.

[21] Appl. No.: 751,335

[22] Filed: Nov. 18, 1996

[51] Int. Cl.[6] ..... A43B 5/00

[52] U.S. Cl. ..... 36/134; 36/59 R; 36/127; 36/67 D; 36/34 A

[58] Field of Search ..... 36/134, 59 R, 36/67 D, 34 A, 127

[56] References Cited

U.S. PATENT DOCUMENTS

| | | | |
|---|---|---|---|
| 2,098,468 | 11/1937 | Shapiro | 36/134 X |
| 2,578,591 | 12/1951 | Phillips | 36/67 D |
| 3,119,192 | 1/1964 | Ronci | 36/34 A |
| 3,133,364 | 5/1964 | Phillips | 36/67 D |
| 3,218,735 | 11/1965 | Ball | 36/34 A |
| 3,577,663 | 5/1971 | Mershon | 36/67 D |
| 3,656,245 | 4/1972 | Wilson | 36/67 D |
| 4,014,114 | 3/1977 | Jordan et al. | 36/67 D |
| 4,527,344 | 7/1985 | Mozena | 36/134 X |
| 4,561,197 | 12/1985 | Misevich | 36/127 |
| 4,723,366 | 2/1988 | Hagger | 36/134 |
| 5,029,405 | 7/1991 | DeHaltre | 36/134 |
| 5,259,129 | 11/1993 | Deacon et al. | 36/127 |
| 5,367,793 | 11/1994 | Deacon et al. | 36/127 |

FOREIGN PATENT DOCUMENTS

| | | | |
|---|---|---|---|
| 2713142 | 10/1978 | Germany | 36/59 R |

*Primary Examiner*—Paul T. Sewell

*Attorney, Agent, or Firm*—Westman, Champlin & Kelly, P.A.

[57] ABSTRACT

A tread is inserted into a shoe sole. The tread includes a base portion and a stem portion which extends away from a first side of the base portion and is connectable to the shoe sole. The stem portion includes longitudinal ridges disposed thereabout and extending radially therefrom. A projection portion extends away from a second side of the base portion.

14 Claims, 7 Drawing Sheets

COUPLING DEVICE FOR A TREAD INSERT

BACKGROUND OF THE INVENTION

The present invention deals with shoe treads. More specifically, the present invention deals with a removable tread connectable to the sole of a shoe.

The game of golf has been very popular for many years and has gained significant popularity in recent years. This is specifically true with respect to women golfers.

Conventional golf shoes include a sole, the exterior portion of which has a plurality of threaded apertures therein. The apertures are threaded to receive removable golf spikes. Traditional removable golf spikes have a circular skirt with a threaded stem extending away from the skirt in one direction, and a metal cleat extending away from the skirt in the opposite direction. The threaded stem is threadable into the threaded apertures in the shoe sole such that, when the golfer wears the shoe, the projecting metal spike is in engagement with the ground or turf.

In temperate climates, golf courses are open all year round. Such courses are typically seeded with one type of grass that grows during the summer, and is dormant during the winter months, and another type of grass which grows during the winter months. For example, many courses are planted with Bermuda grass which grows during the summer months and goes dormant in the winter. Then, in the winter months, the golf course is overseeded with rye grass which grows during the winter months, and then dies.

Walking on the dormant grass with the conventional metal golf spikes can be highly detrimental to the dormant grass, and therefore detrimental to the condition of the course. Also, many golf courses, both public and private, have decided that the conventional metal golf spikes cause an undesirable amount of damage to both the fairways and greens, even on courses which are only open during one season, or on courses on which play is not allowed when the grass is dormant. Therefore, many golf courses no longer allow conventional metal golf spikes to be used at all.

In an effort to provide alternative spikes which do not damage the golf course, others have attempted to provide "spikeless" golf treads for use with golf shoes. For example, the Deacon et al. U.S. Pat. Nos. 5,259,129 and 5,367,793 show a skirt which has a threaded stem extending from one surface of the skirt. A plurality of radially, outwardly extending ridges are also provided, and extend from a second side of the skirt. The radially extending ribs purportedly provide some amount of traction, over and above flat shoes, but do not damage the course as much as conventional metal golf spikes.

However, the treads discussed in the Deacon et al. patents suffer from at least one significant drawback. Applicants have found that the radially extending ribs define channels which tend to catch and trap mud and other debris therebetween. When the debris fills in the area between the ribs, the traction-providing capacity of the treads is significantly diminished.

Also, traditional spikes, such as those shown in the Deacon et al. patents, are formed with the skirt portion being concave against the shoe sole. Such a surface is undesirably sensitive to unevenness and wear.

Furthermore, some of the commercially available spikeless golf treads attach to a golf shoe by threading a soft solid stem into the metallic inner treads in a conventional golf shoe. The soft plastic, required to conform to the treads of the golf shoe, does not provide a solid anchoring mechanism and also significantly reduces the life of the tread due to wear.

SUMMARY OF THE INVENTION

A tread is insertable into a shoe sole. The tread includes a base portion and a stem portion which extends away from a first side of the base portion and is connectable to the shoe sole. The stem portion includes longitudinal ridges disposed thereabout and extending radially therefrom. A projection portion extends away from a second side of the base portion.

DETAILED DESCRIPTION OF THE PREFERRED EMBODIMENTS

Figure 1A:
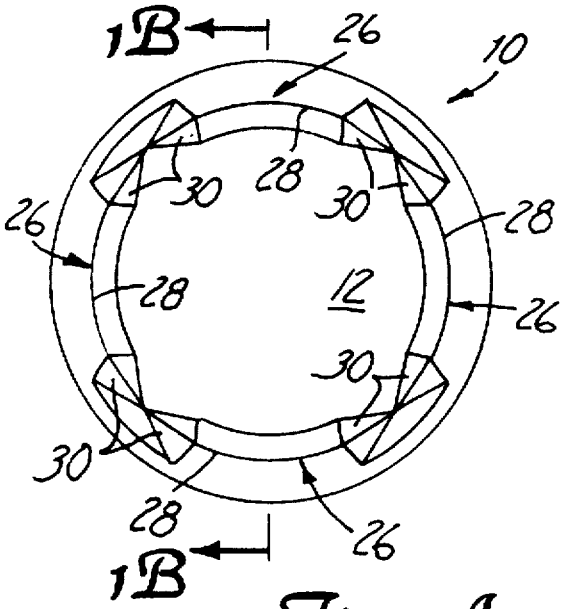
FIG. 1A is a top plan view of a first embodiment of a tread according to the present invention.
Figure 1B:
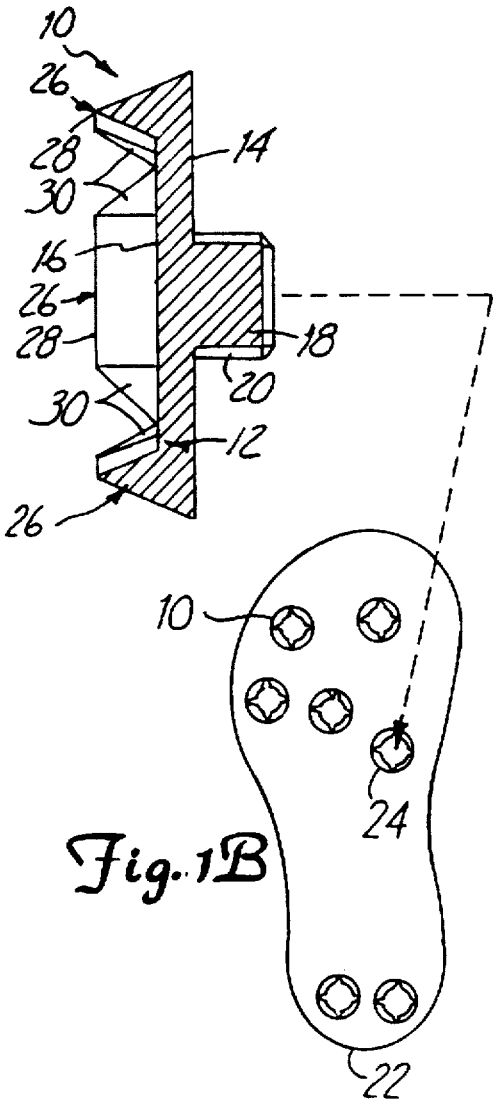
FIG. 1B is a side sectional view of the tread shown in FIG. 1A, and taken along section lines 1B—1B.

FIG. 1A is a top plan view of one preferred embodiment of a tread 10 according to the present invention. FIG. 1B is a side sectional view of tread 10 taken along section lines 1B—1B in FIG. 1A. Tread 10 includes, in the preferred embodiment, a generally circular base portion 12. Base portion 12 has a first side 14 and a second side 16. A stem portion 18 extends away from the first side 14. Stem portion 18 has a threaded outer periphery 20. FIG. 1B also shows the sole portion of a golf shoe 22. Golf shoe 22 is shown with a plurality of spikes 10 engaged therewith. Shoe 22 also shows a threaded aperture 24. Stem portion 18 is threadably engageable within threaded aperture 24 to secure tread 10 in the sole of shoe 22.

Tread 10 also has a plurality of extension portions 26. Extension portions 26 extend away from second surface 16 of base portion 12. While there may be any number of extension portions 26, the embodiment shown in FIGS. 1A and 1B includes four extension portions. It is believed that a number between three and six extension portions is preferred.

In the embodiment shown in FIGS. 1A and 1B, extension portions 26 have a ridge portion 28 and end portions 30. End portions 30 are preferably tapered and extend between ridge portion 28 and the second side 16 of base portion 12.

Also, in the preferred embodiment, base portion 12, extension portions 26 and stem portion 18, are all integrally formed with one another. In the preferred embodiment, these portions are formed of a suitable, durable polymer material, such as poly block urethane, polyester, or other suitable material. It should also be noted that these portions can be separately formed and assembled together in order to form the desired tread. However, in the preferred embodiment, they are molded, or otherwise formed, integrally with one another.

Figure 2A:
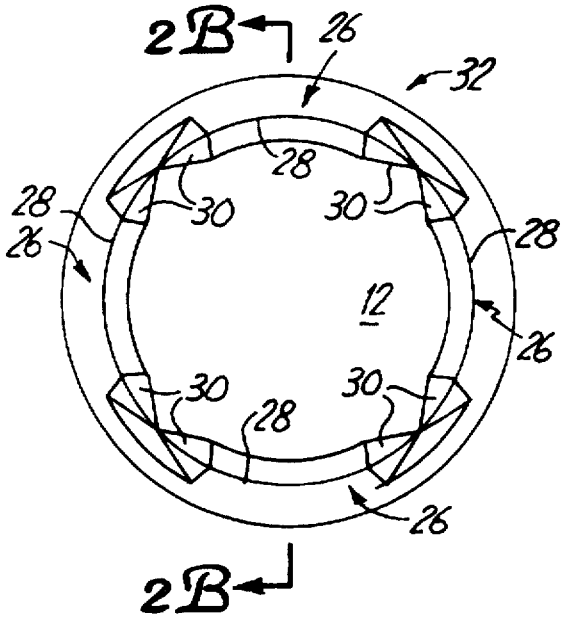
FIG. 2A is a top plan view of a second embodiment of a tread according to the present invention.
Figure 2B:
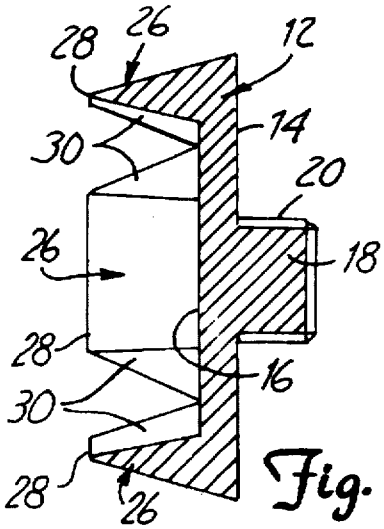
FIG. 2B is a side sectional view of the tread shown in FIG. 2A, and taken along section lines 2B—2B.

FIG. 2A is a top plan view of another embodiment of a tread 32 according to the present invention. FIG. 2B is a side sectional view of tread 32 taken along section lines 2B—2B in FIG. 2A. A number of items are similar to those shown in FIGS. 1A and 1B and similar items are similarly numbered. The difference between tread 10 and tread 32 is that the extension portions 26 extend further from second side 16 of base portion 12 in tread 32 than they do in tread 10. For instance, in the embodiment shown in FIG. 1B, the total height of extension portions 26 (from side 14 of base portion 12 to ridge portion 28) is preferably approximately one-quarter of the diameter of base portion 12 of tread 10. The extension portions 26 in FIGS. 2A and 2B extend away from the base portion 12 by a distance of approximately one-third of the diameter of base portion 12. While the present invention is contemplated to cover any reasonable dimension, these two dimensions are simply shown to illustrate that many dimensions are useable.

Figure 3A:
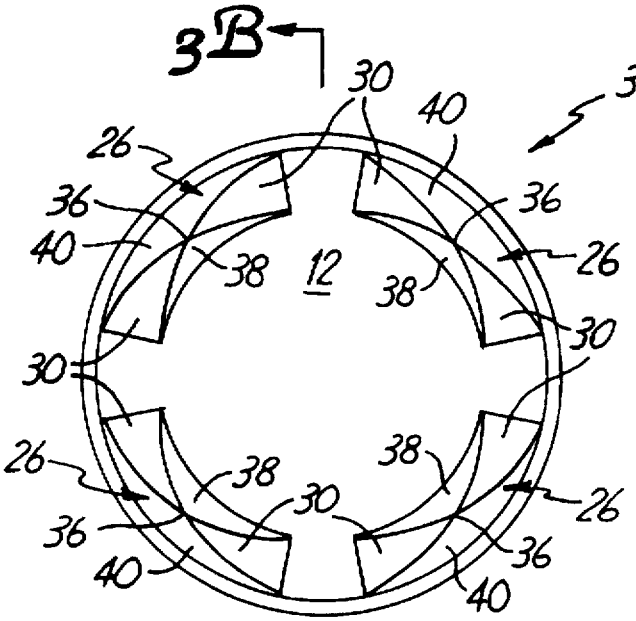
FIG. 3A is a top plan view of a third embodiment of a tread according to the present invention.
Figure 3B:
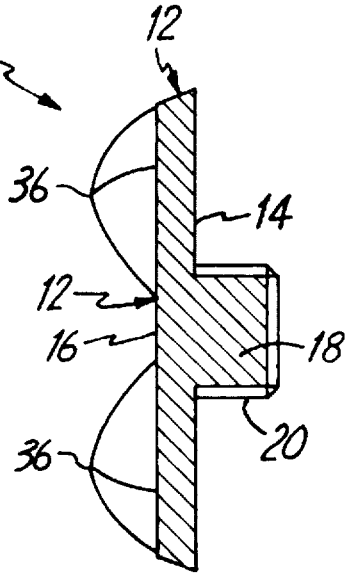
FIG. 3B is a side sectional view of the tread shown in FIG. 3A, and taken along section lines 3B—3B.

FIGS. 3A and 3B show a top plan view, and a side sectional view, respectively, of a third embodiment of a tread 34 according to the present invention. Similar items are similarly numbered to those shown in FIGS. 1A–2B. The tapered sections 30, in the embodiment shown in FIGS. 3A and 3B, extend substantially to a pinnacle 36. Also, extension members 26 in FIGS. 3A and 3B have inner and outer tapered sections 38 and 40 which extend between base portion 12 and pinnacle 36. Thus, extension portions 26 substantially form pyramid-shaped sections which are spaced from one another about the periphery of base portion 12.

Figure 4A:
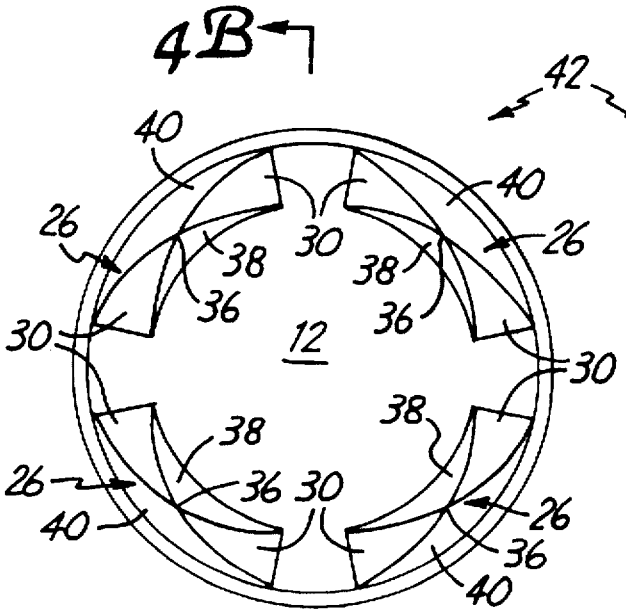
FIG. 4A is a top plan view of a fourth embodiment of a tread according to the present invention.
Figure 4B:
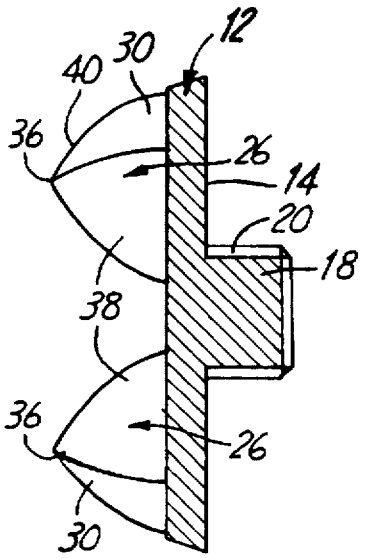
FIG. 4B is a side sectional view of the tread shown in FIG. 4A, any taken along section lines 4B—4B.

FIGS. 4A and 4B show another embodiment of a tread 42 according to the present invention. Tread 42 is highly similar to tread 34 shown in FIGS. 3A and 3B, except that FIGS. 4A and 4B illustrate a different height-to-diameter ratio for tread 42 than that shown for tread 34. FIGS. 4A and 4B are simply provided to illustrate that a large variety of height-to-diameter ratios are contemplated by the present invention.

Figure 5A:
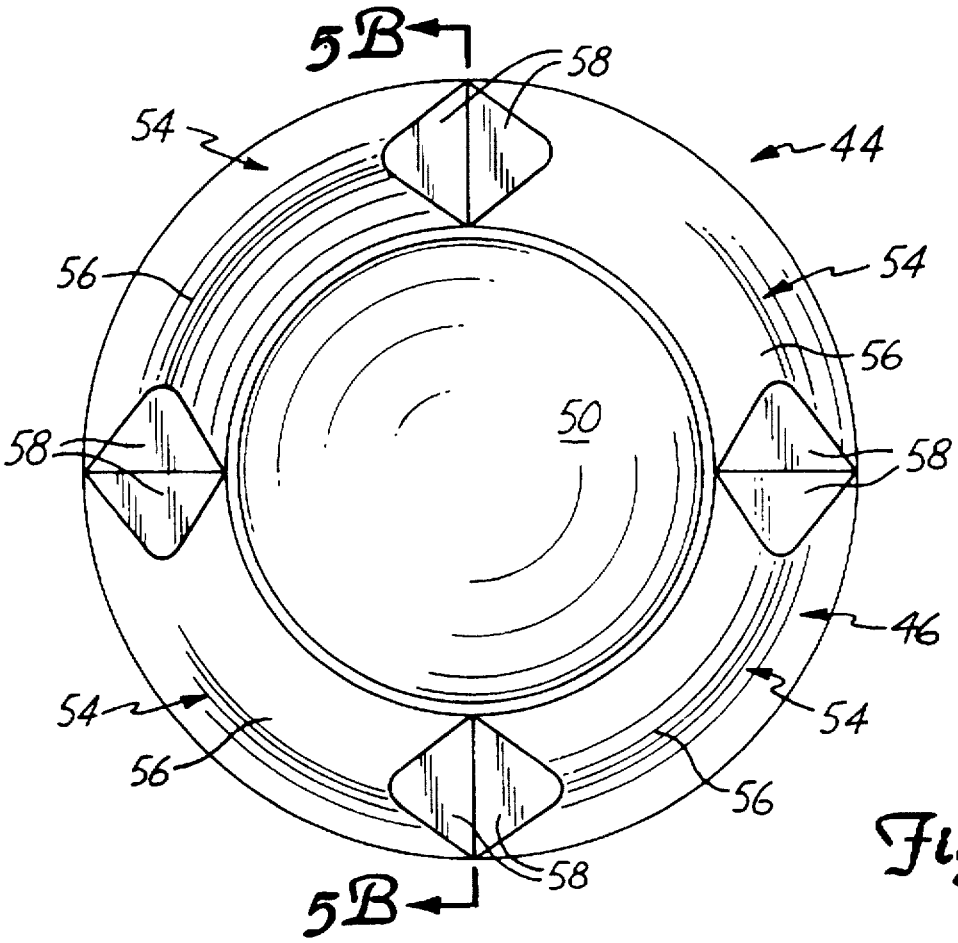
FIG. 5A is a top plan view of a fifth embodiment of a tread according to the present invention.
Figure 5B:
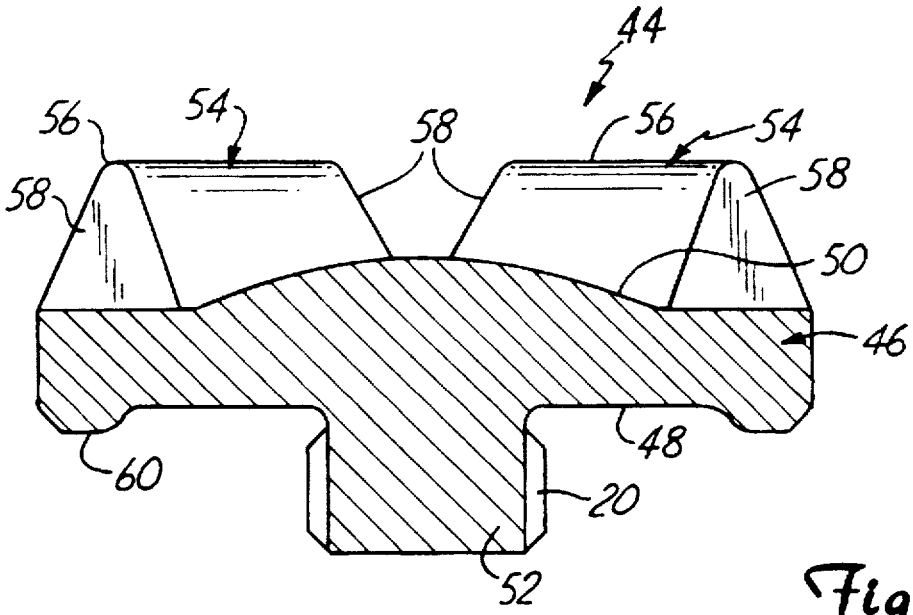
FIG. 5B is a side sectional view of the tread shown in FIG. 5A, and taken along section lines 5B—5B.

FIGS. 5A and SB are a top plan view, and side sectional view, respectively, of another embodiment of a tread 44 according to the present invention. Tread 44 includes a base portion 46 having a first side 48 and a second side 50, a stem portion 52 and extension portions 54. As with the previous embodiments, stem portion 52 extends away from first side 48 of base portion 46 and has a threaded outer periphery 20. Extension portions 54 extend away from second side 50 of base portion 46. In the embodiment shown in FIGS. 5A and 5B, extension portions 54 are generally triangular in cross-section terminating at an upper curved ridge portion 56. Also, tapered end sections 58 extend between tie first side 50 of base portion 56 and the curved ridge portions 56. Therefore, extension portions 54 form generally annular ridge sections spaced by gaps formed by generally opposing tapered end sections 58.

In addition, the first side 50 of base portion 46 is formed, at approximately its center, in a generally convex shape extending outwardly away from base portion 46. It is believed that such a shape significantly reduces the build-up of, or adherence of, mud and other debris on tread 44.

Tread 44 also has an extension portion 60 extending from the first side 48 of tread 44. In the embodiment shown in FIG. 5B, extension member 60 is a continuous annular ridge or ring formed about the periphery of base portion 46. Ridge 60 is a shoe-contacting ridge which engages the sole of the shoe into which tread 44 is inserted. This provides a significantly greater amount of stability than traditional metal spikes which were formed with simply a concave skirt positioned in facing relation to the shoe sole. It should also be noted, however, that extension portion 60 could be formed as a plurality of generally annular ridge portions, or other discontinuous configurations which engage the shoe sole.

Figure 6A:
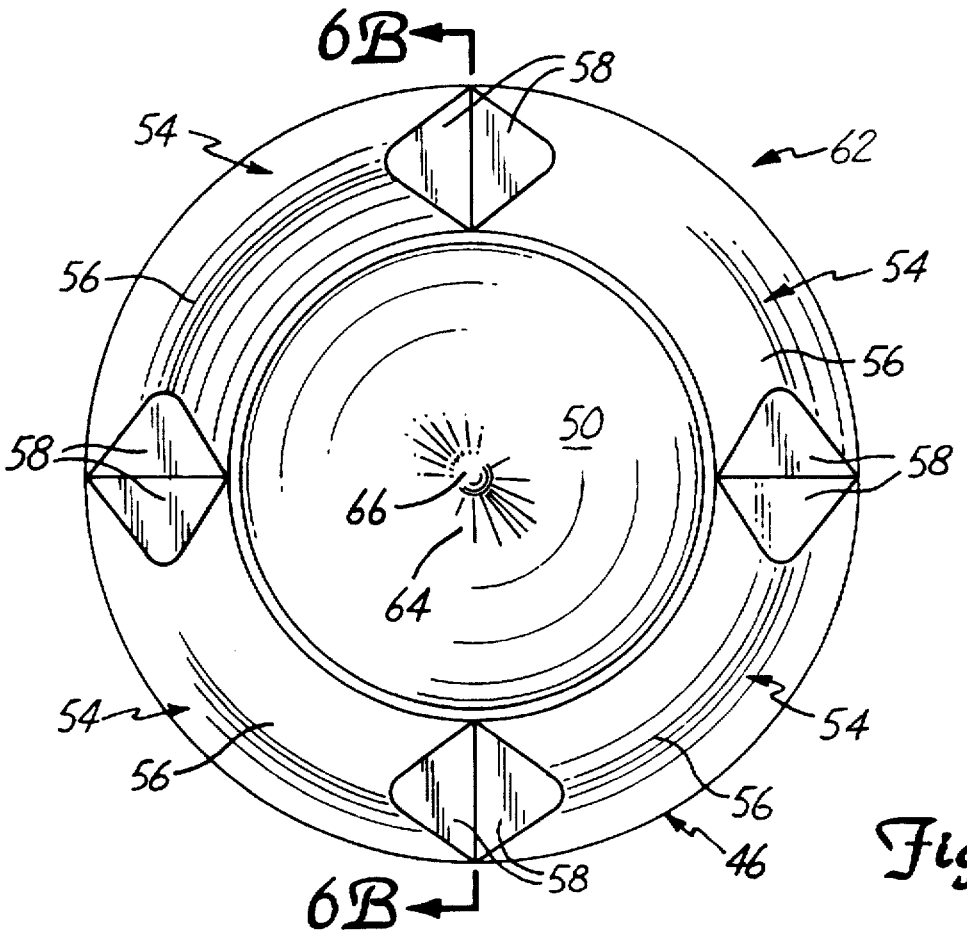
FIG. 6A is a top plan view of a sixth embodiment of a tread according to the present invention.
Figure 6B:
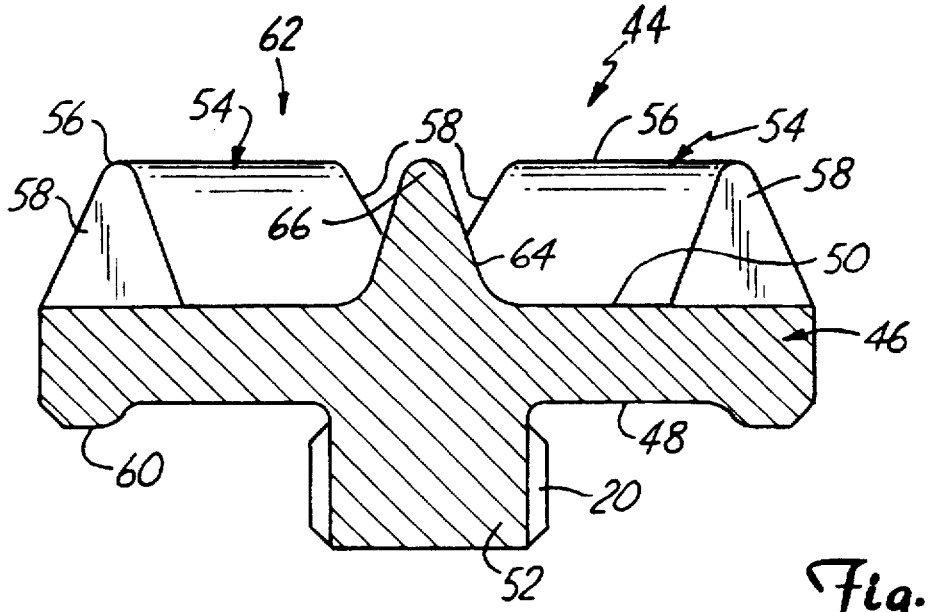
FIG. 6B is a side sectional view of the tread shown in FIG. 6A, and taken along section lines 6B—6B.

FIGS. 6A and 6B show a top plan view, and side sectional view taken along section lines 6B—6B, respectively, of another embodiment of a tread 62. Tread 62 is similar to tread 44 shown in FIGS. 5A and 5B and similar items are similarly numbered. However, the surface on second side 50 of base portion 46 is shaped differently than that of tread 44. Rather than having a gentle concave surface, or one which extends substantially from the periphery of base 46 to its center, the surface defining side 50 of tread 62 is substantially flat throughout base portion 46 except generally at the center of side 50. At that point, side 50 rises to a substantially cone-shaped surface 64 and terminates in a generally curved upper tip portion 66.

Figure 7A:
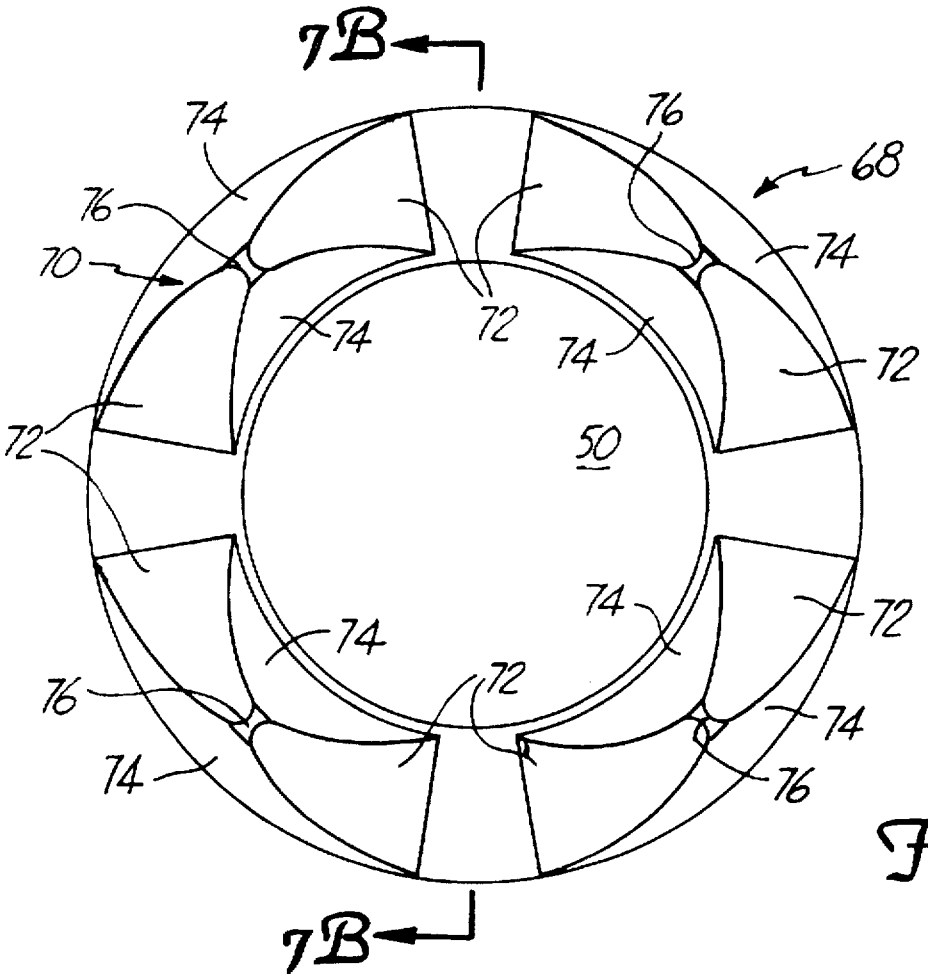
FIG. 7A is a top plan view of a seventh embodiment of a tread according to the present invention.
Figure 7B:
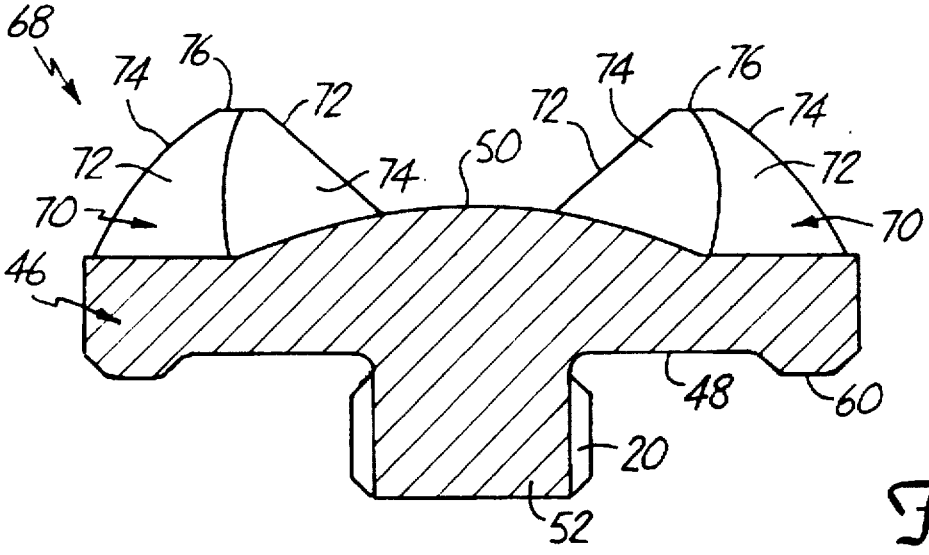
FIG. 7B is a side sectional view of the tread shown in FIG. 7A, and taken along section lines 7B—7B.

FIGS. 7A and 7B show another embodiment of a tread 68 according to the present invention. FIG. 7A is a top plan view and FIG. 7B is a side sectional view taken along section lines 7B—7B in FIG. 7A. Tread 68 is similar to tread 44 shown in FIGS. 5A and 5B, and similar items are similarly numbered. However, tread 68 is provided with different extension portions 70 than is tread 44. Extension portions 70 have tapered end sections 72 and generally opposed tapered side sections 74 which all terminate in a pinnacle region 76. Thus, extension portions 70 generally form pyramids disposed about the periphery of base portion 46.

Figure 8A:
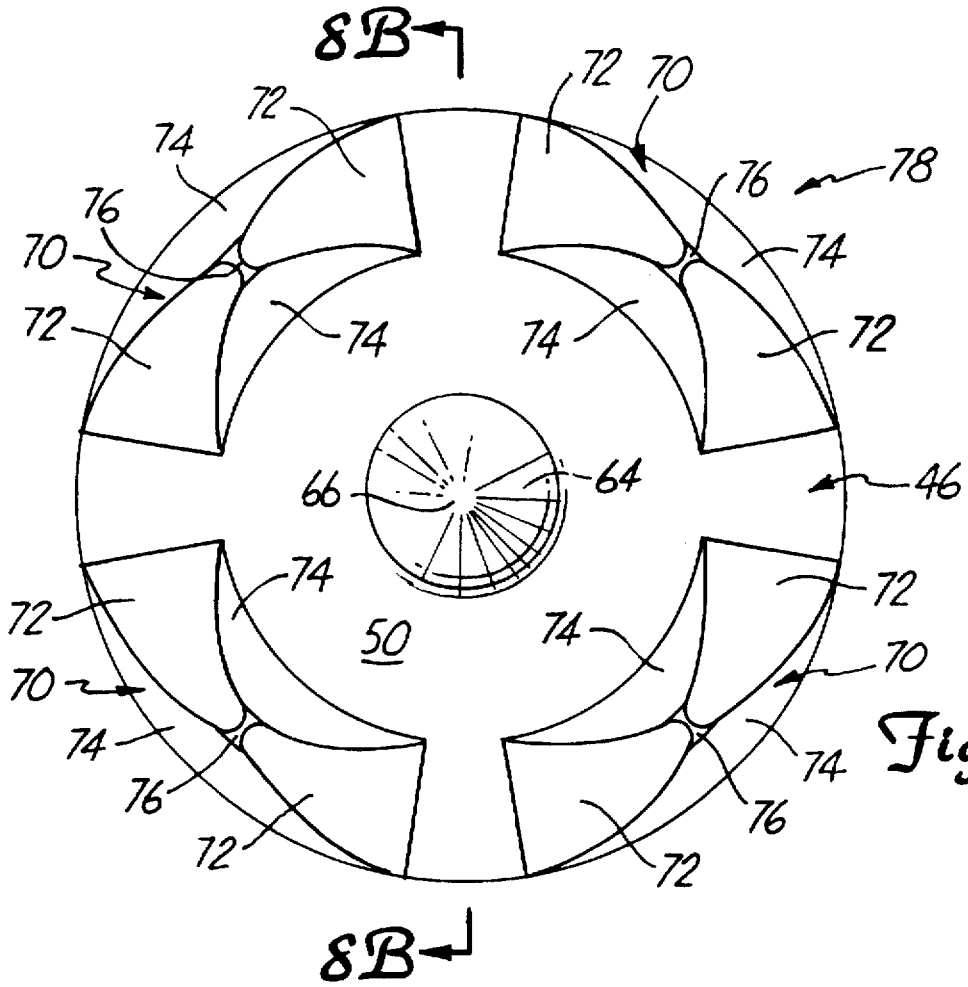
FIG. 8A is a top plan view of an eighth embodiment of a tread according to the present invention.
Figure 8B:
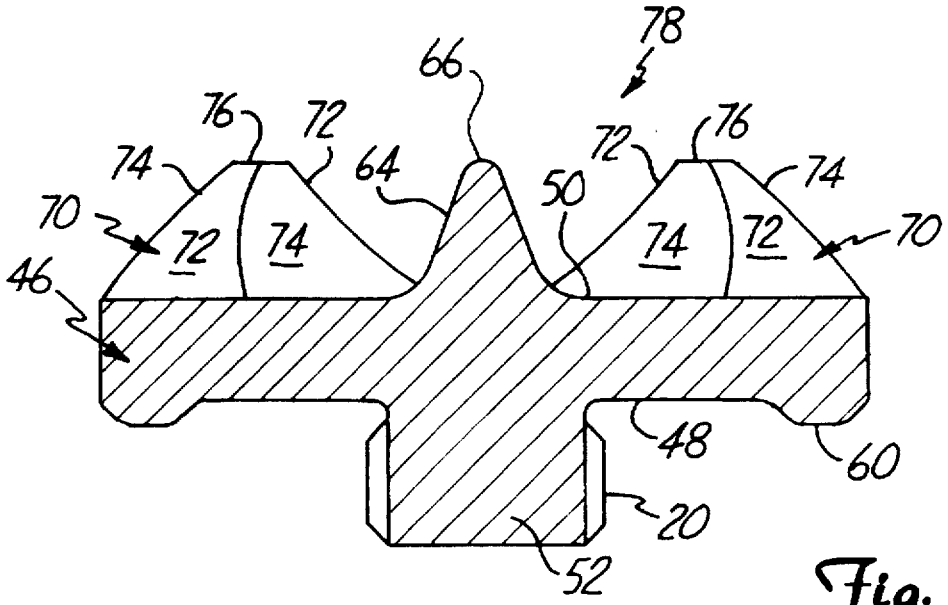
FIG. 8B is a side sectional view of the tread shown in FIG. 8A, and taken along section lines 8B—8B.

FIGS. 8A and 8B show another embodiment of a tread 78 according to the present invention. FIG. 8A is a top plan view, and FIG. 8B is a side sectional view taken along section lines 8B—8B in FIG. 8A. Tread 78 is similar to tread 62 shown in FIGS. 6A and 6B. However, rather than having projection portions 54, tread 78 has projection portions 70, similar to those shown in FIGS. 7A and 7B. Thus, projection portions 70 perform substantially pyramid-shape projections disposed about the periphery of base portion 46.

Figure 9A:
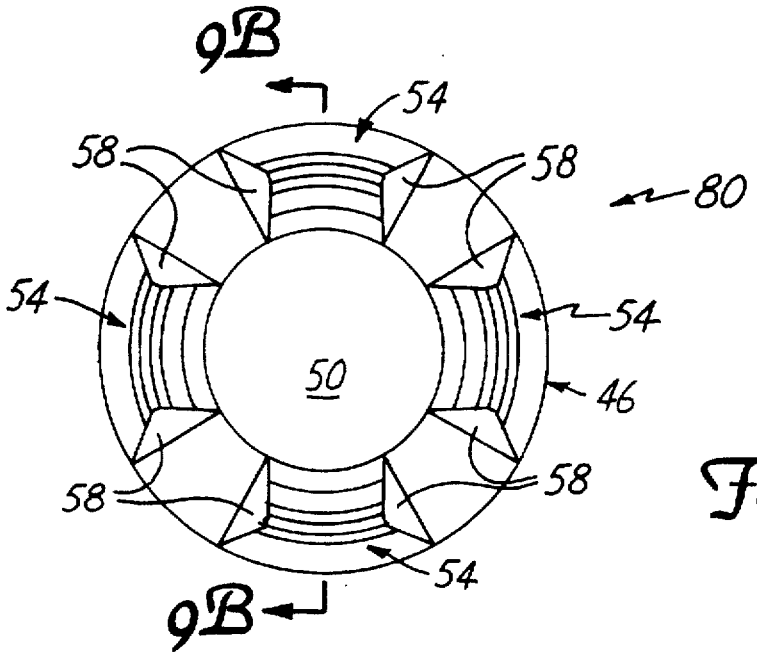
FIG. 9A is a top plan view of a ninth embodiment of a tread according to the present invention.
Figure 9B:
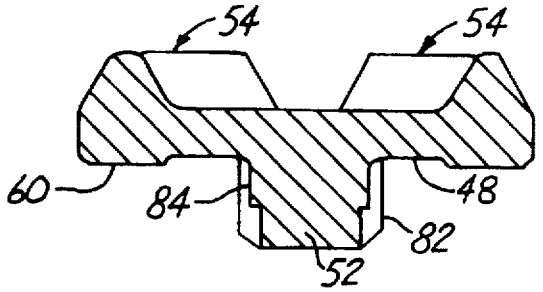
FIG. 9B is a side sectional view of the tread shown in FIG. 9A, and taken along section lines 9B—9B.

FIGS. 9A and 9B show another embodiment of a tread 80 according to the present invention. FIG. 9A is a top plan view, and FIG. 9B is a side sectional view taken along section lines 9B—9B in FIG. 9A. Tread 80 is similar to tread 44 shown in FIGS. 5A and 5B. However, rather than having tapered end sections 58 in communication with one another, tapered end sections 58 are spaced apart about the periphery of tread 80.

Figure 10:
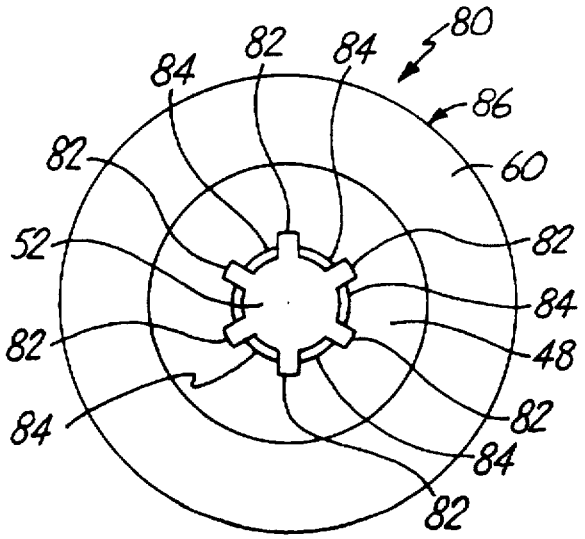
FIG. 10 is a bottom plan view of a preferred embodiment of a tread according to the present invention.

FIG. 10 is a bottom plan view of tread 80 according to the present invention. Tread 80 comprises ridge 60 which is similar to that shown in FIG. 5B, and a first side 48 which is also similar to that shown in FIG. 5B. Stem 52 is preferably integrally formed with tread 80, and extends from first side 48. Ridges 82 are disposed about stem 52, and are generally aligned with the longitudinal axis of stem 52. In one preferred embodiment, stem 52 is also provided with collar segments 84. Collar segments 84 are interposed between ridges 82 about stem 52, and extend partially from first surface 48 along stem 52. Ridges 82 provide strength and rigidity to stem 52 while facilitating threading to the internal treads of a conventional golf shoe (not shown). Because only ribs 82 contact the internal treads of a conventional golf shoe, less torque is required to be applied for the threading operation than would be required if stem 52 were a solid cylinder. By facilitating the threading operation, harder plastic such as polyurethane may also be used in the construction of tread 80 such that wear and durability characteristics of the tread are improved. It should be noted that although the embodiment shown in FIG. 10 is described with respect to tread 80, it may be applied to any tread.

It should also be noted that treads according to the present invention may also be provided with suitable apertures for receiving tangs which extend from a conventional spike wrench. The tangs are inserted within the apertures and used in tightening the spikes in the shoe sole. Further, the tangs of the spike wrench may also be placed between extension portions according to the present invention and used in tightening the treads. Engagement between the tangs of the spike wrench and the spaces between extension portions according to the present invention can also be used in tightening the treads to the shoe sole.

Therefore, the present invention provides a tread insertable into an aperture in a shoe sole which has a base portion and one or more extension portions. The extension portions are proximate the periphery of the base portion and extend away from the base portion. One embodiment of the present invention also provides a contoured inner portion which is in the interior of the periphery of the base portion. This is believed to result in less build-up of mud and debris in the tread. Further, in yet another feature of the present invention, an extension portion is also provided which extends toward the shoe sole. This results in greater stability in the tread.

Also, a feature of the present invention provides longitudinally extending portions along the periphery of the stem. This allows the use of harder plastic which increases the life of the tread and also provides better anchoring of the tread to the shoe.

Although the present invention has been described with reference to preferred embodiments, workers skilled in the art will recognize that changes may be made in form and detail without departing from the spirit and scope of the invention.

What is claimed is:

1. A tread insert for insertion into a shoe sole, the tread insert comprising:

a base portion;

a stem portion extending from the first side of the base portion the stem portion having spaced longitudinal ridges extending about the stem portion to define an outer periphery thereof, said stem portion being sized for engagement of the outer periphery with a threaded aperture of a shoe sole, the longitudinal facilitating rotation of the stem portion within the threaded aperture to define a self-tapping stem portion; and a tread portion extending away from a second side of the base portion.

2. The tread insert of claim 1 wherein the longitudinal ridges have essentially a rectangular-shaped cross-section.

3. The tread insert of claim 1 wherein the ridges further comprise a tapered thread engaging end disposed in spaced relation to the base portion.

4. The tread insert of claim 1 wherein the stem portion includes a collar segment aligned coextensively with an extent of the longitudinal ridges.

5. The tread insert of claim 1 wherein the insert is constructed from a plastic material.

6. The tread insert of claim 5 wherein the tread insert is constructed from polyurethane.

7. A tread insert having a stem for connecting the insert to a shoe sole wherein the stem comprises longitudinal ridges disposed thereabout and extending radially therefrom to define an outer periphery of the stem, said outer periphery being sized for engagement with a threaded aperture, the longitudinal ridges being formed of a material facilitating rotation of the stem within a threaded aperture to define a self-tapping stem.

8. The tread insert of claim 7 wherein the longitudinal ridges comprise a first end proximate a ground engaging portion of the tread, a second end proximate a shoe engaging end of the insert, and a tapered portion disposed coextensive with the second end.

9. The tread insert of claim 7 wherein the stem portion includes a collar segment positioned coextensively with an extent of the longitudinal ridges.

10. The tread insert of claim 7 wherein the tread insert is constructed from plastic.

11. The tread insert of claim 7 wherein the tread insert is constructed from polyurethane.

12. The tread insert of claim 1 wherein the longitudinal ridges are formed of a polyurethane material.

13. A tread insert for insertion into a tread receiving socket in a golf shoe, the tread insert comprising:

a base portion;

a contoured ground engaging surface on a first side of the base portion; and a stem extending from a second side of the base portion and, the stem including spaced longitudinal protrusions extending therefrom and formed of a material facilitating rotation of the stem within a tread receiving socket to define self-tapping threads when the tread insert is inserted in the tread receiving socket.

14. In combination:

a golf shoe having a sole including at least one threaded aperture;

a tread insert including:

a tread portion; and a coupling device operably coupled to the thread portion for selectively connecting the tread insert relative to the golf shoe, the coupling device including:

a stem portion operably coupled to the tread portion, the stem portion being adapted for insertion into the threaded aperture of the golf shoe, the stem portion including:

longitudinal ridges extending along a length of the stem portion, said longitudinal ridges being formed of a self-tapping material facilitating rotation of the stem portion within the threaded aperture of the shoe sole.

* * * * *